US007891026B1

(12) United States Patent
Smith

(10) Patent No.: US 7,891,026 B1
(45) Date of Patent: Feb. 22, 2011

(54) ATHLETIC GARMENT WITH ARTICULATED BODY PROTECTIVE UNDERLAYER

(75) Inventor: Michael K. Smith, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 660 days.

(21) Appl. No.: 11/620,950

(22) Filed: Jan. 8, 2007

(51) Int. Cl.
*A41D 13/00* (2006.01)

(52) U.S. Cl. ..... 2/465

(58) Field of Classification Search ..... 2/267, 2/22, 24, 227, 228, 455, 466, 69, 465, 79, 2/911

See application file for complete search history.

(56) References Cited

U.S. PATENT DOCUMENTS

| | | | | |
|---|---|---|---|---|
| 1,660,342 | A | 2/1928 | Levinson | |
| 1,669,085 | A | 5/1928 | Guyon | |
| 1,757,640 | A | 5/1930 | Levinson | |
| 1,803,335 | A | 5/1931 | Levinson | |
| 1,857,850 | A | 5/1932 | Jones | |
| 1,944,127 | A | 1/1934 | Jones | |
| 2,629,094 | A | 2/1953 | Goldsmith | |
| 3,484,868 | A | 12/1969 | Davenport, Jr. | |
| 4,807,301 | A * | 2/1989 | Ferber | 2/465 |
| 5,161,257 | A | 11/1992 | Arensdorf et al. | |
| 5,168,576 | A | 12/1992 | Krent et al. | |
| 5,365,610 | A | 11/1994 | Lubahn et al. | |
| 5,405,312 | A * | 4/1995 | Jacobs | 602/5 |
| 5,423,087 | A | 6/1995 | Krent et al. | |
| 5,497,511 | A | 3/1996 | Zade | |
| 5,572,737 | A * | 11/1996 | Valice | 2/465 |
| 5,689,836 | A * | 11/1997 | Fee et al. | 2/465 |
| 5,717,997 | A * | 2/1998 | Garcia | 2/23 |
| 6,070,273 | A | 6/2000 | Sgro | |
| 6,408,446 | B1 * | 6/2002 | Carrington | 2/465 |
| 6,532,599 | B1 | 3/2003 | Dugan | |
| 6,654,960 | B2 | 12/2003 | Cho | |
| 6,804,832 | B2 | 10/2004 | Beland | |
| 7,412,731 | B1 * | 8/2008 | Brassill | 2/456 |
| 2002/0042944 | A1 | 4/2002 | Beland | |
| 2006/0059609 | A1 | 3/2006 | Moss | |

* cited by examiner

*Primary Examiner*—Tejash Patel
(74) *Attorney, Agent, or Firm*—Plumsea Law Group, LLC.

(57) ABSTRACT

Athletic apparel containing protective underlayer comprising molded foam padding that are shaped and curved to match the anatomical regions to reduce the bulk of the underlayers. The molded foam pads a perforated structure to allow for increased flexibility and ventilation. Protective underlayers that surround regions of motion, such as the hip joint, are notched to provide articulation of the protective underlayer that will improve mobility of the athletic apparel wearer.

25 Claims, 13 Drawing Sheets

ATHLETIC GARMENT WITH ARTICULATED BODY PROTECTIVE UNDERLAYER

BACKGROUND OF THE INVENTION

1. Field of the Invention

This invention relates to the field of protective body padding and athletic apparel, and more particularly to athletic apparel containing an articulated body protective underlayer molded in a curved shape to anatomically fit on or about the body part to be protected.

2. Background of the Invention

Many athletic activities require protection and padding for various body parts. One of the challenges in protecting body parts is to provide for freedom of movement to the athlete while still providing sufficient protection from blows from other players or equipment. Athletic apparel for the lower body for contact sports such as football, basketball, and hockey is usually padded. The problem has been to achieve the balance between sufficient padding and enabling unencumbered movement of the legs at the hip joint. Another concern is providing sufficient ventilation through the padding to prevent overheating of the athlete.

Athletic apparel containing padding for various body parts has been described previously. Dugan, U.S. Pat. No. 6,532,599, describes athletic pants containing pockets for padding to cover the hips, thigh, and coccyx. The padding in these athletic pants do not provide the ability to articulate which may restrict the mobility of the athlete nor does the padding have any means for ventilation. There have been several attempts to provide athletic apparel with padding possessing the ability to articulate, such as those described by Krent et al., U.S. Pat. No. 5,423,087, and Zade et al., U.S. Pat. No. 5,497,511. Krent et al. and Zade et al. are incorporated by reference in their entirety. Krent et al. provides athletic apparel containing padding with the ability to articulate in a vertical axis or in a horizontal axis. These axes are not aligned with the anatomical axes of rotation for the hip during running and may in fact restrict the mobility of the athlete while running. Furthermore, Krent et al. does not provide ventilation in the padding. Zade et al. provides modules of padding connected by an elastic membrane that allow for mobility between the modules as well as channels for ventilation through the modules of padding and the connecting membranes around the modules. This approach, while providing many degrees of articulation, does not sufficiently cover all of the desired regions of protection. The anatomical axes of rotation commonly occur in the same regions that protection is desired, and the modular design would require that the elastic membrane be positioned where the axis of rotation crosses the padding. As a result, the region of desired protection would not have complete coverage by padding. The resultant exposure of regions of the body that are prone to injury will not ensure that the protection provided by the athletic apparel is effective in its protection of the athlete.

Ventilation is another important aspect of providing comfortable athletic apparel. The ventilation approach described by Zade et al. was appropriate for increasing comfort, but that solution had deficiencies with respect to protection coverage. Another manner for providing continuous coverage with ventilation is the solution described by Cho, U.S. Pat. No. 6,654,960. Cho describes a shin pad that has a network of pie-shaped perforations arranged hexagonally throughout the pad. This design provides complete coverage of the desired body part as well as complete ventilation. However, Cho's pad is for protecting the shin and does not articulate, and therefore does not solve the challenge of providing mobility via articulation for certain regions of the body.

There is a need in the field for athletic apparel containing padding that provides anatomical coverage of body parts requiring protection and which is configured to articulate about anatomically relevant axes to provide unencumbered mobility of the athlete; as well as provide adequate ventilation to the athlete.

SUMMARY

A padded underlayer for athletic apparel is designed to protect the athlete while maximizing mobility and comfort. A plurality of discrete padded underlayer elements are integrated into a garment such as protective athletic pants. For activities such as football, basketball there may be several lower body areas that need to be protected from impact including, for example, the thighs, the hip joint and the coccyx. Each of these regions of the lower body is protected by a padded underlayer element that is anatomically shaped to most closely approximate the shape and curvature of the region requiring protection. In some cases the anatomic shape requires configuring the underlayer element to facilitate movement of a protected region. For example, the underlayer element can be shaped to facilitate articulation of the thigh with respect to the hip joint.

Another aspect of the protective underlayer element concerns the internal structure of the padding material which comprises at least one perforated region generally surrounded by a continuous region. The continuous region provides a ring of support around the perforated region, while the perforated region provides flexibility and ventilation to the wearer. A plurality of perforated regions may be set off from one another by continuous regions in a single underlayer element. The design and configuration of the continuous and perforated regions can be based on the anatomical needs of the portions of the wearer's body to be protected. For example, continuous regions tend to be stiffer and may offer more protection, and thus should generally be placed in areas that require the most protection. On the other hand, perforated regions are lighter and more flexible and may be placed in areas that must bend or articulate with the athlete's body.

In another aspect, the padding is anatomically shaped, contains perforated regions for flexibility and ventilation, and continuous regions for enhanced protection, and where applicable contains features that allow for articulation about anatomically relevant axes of rotation.

In another aspect of the invention, the athletic garment comprises a hip underlayer that is positioned to be disposed over a wearer's hip joint, specifically a wearer's iliac crest, femoral head, femoral neck and greater trochanter. The hip underlayer incorporates a contoured molded foam pad with a notch-cut to be disposed over a wearer's axis of rotation of the hip joint during running or walking, and also includes a continuous, non-perforated area to provide enhanced protection and a perforated area to provide flexibility, ventilation and reduce bulk. The continuous region may surround the perforated region of the foam pad to provide a ring of protection.

In another aspect of the invention, the athletic garment comprises a coccyx underlayer positioned to be disposed over a wearer's coccyx and sacrum, and incorporating a contoured molded foam pad having a continuous, non-perforated region and a perforated region.

In another aspect of the invention, the athletic garment comprises a thigh padded underlayer positioned to be disposed over a portion of a wearer's thigh, and incorporating a contoured molded foam pad having a perforation pattern. The thigh underlayer its foam pad can be shaped and contoured to provide coverage from the medial anterior aspect to the lateral anterior aspect of the thigh. Alternatively, the thigh underlayer and its foam pad can be shaped and contoured to form front, side and rear portions to provide coverage from the medial anterior aspect of the thigh around the lateral aspect of the thigh to the medial posterior aspect of the thigh. In each of these cases, the foam pad has a plurality of perforated regions each surrounded by continuous, non-perforated regions to provide enhanced protection and stiffness as desired.

In another aspect of the invention, the athletic garment may include one or any combination of the hip, thigh and coccyx underlayers.

In another aspect of the invention, each of the hip, coccyx and thigh underlayers incorporates a molded foam pad having a perforation structure comprising at least one perforated region formed of a repeating grid of perforations. The repeating grid comprises interlocking hexagonal units, each said unit formed by triangular perforations arranged around a center point to form ribs.

The above objects are achieved through anatomically matching the underlayer padding of an athletic garment to match the shape and the curvature of each region requiring protection. Additionally, the underlayer padding contains perforated regions to provide ventilation to the athlete. The perforations are preferably triangular in shape and arranged in interlocking hexagonal patterns. The underlayer padding contains continuous regions that have no perforations to provide additional rigid protective support to the regions requiring protection. The underlayer padding may also contain features that allow for articulation. For regions that articulate requiring protection, such as the hip, the underlayer padding is specifically designed with a notched feature to allow for articulation around the anatomical axis of rotation for the hip during activities such as running or walking.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Figure 1:
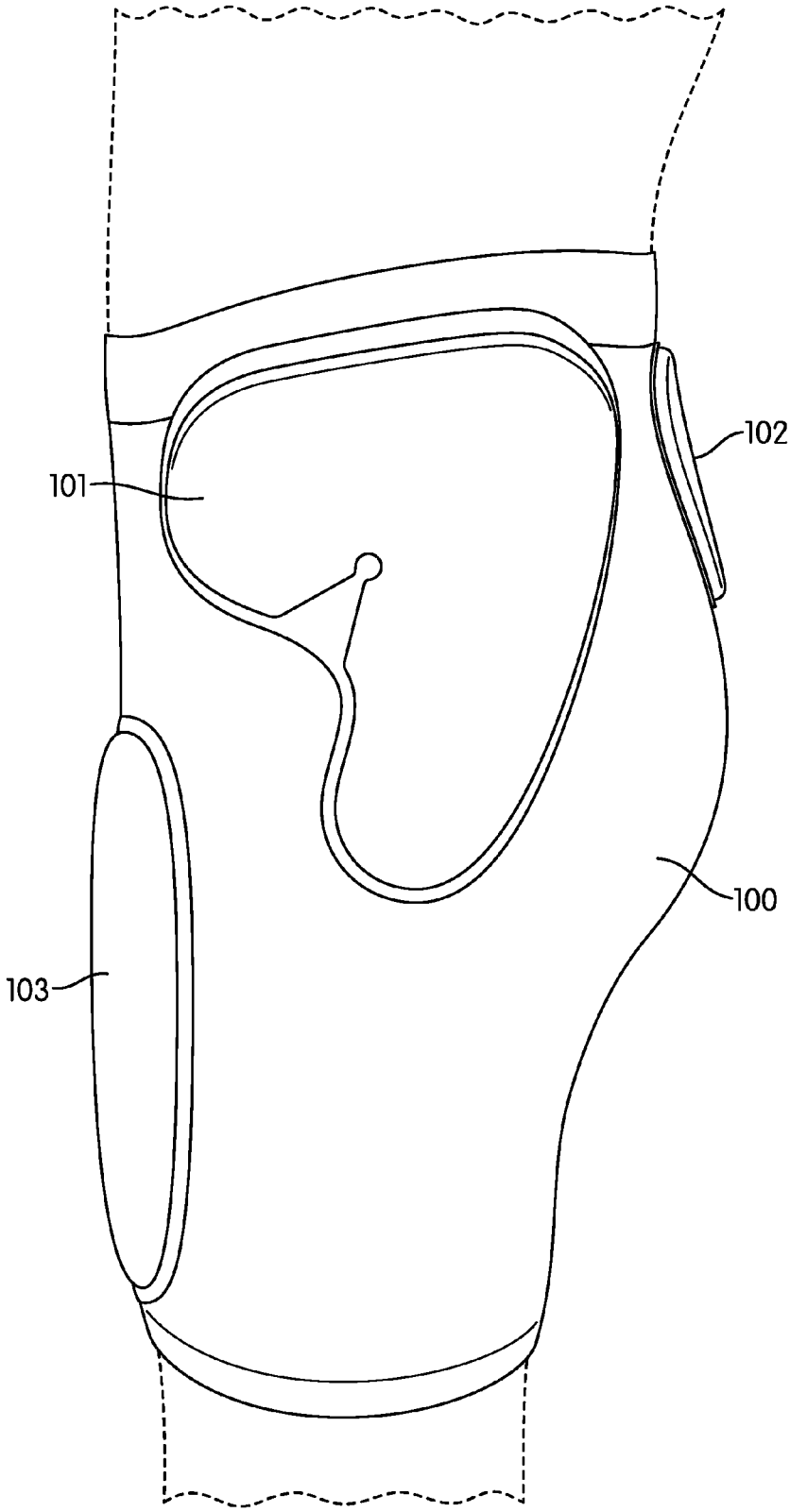
FIG. 1 is a side view of a lower body garment incorporating the articulated protective hip underlayer, the protective coccyx underlayer, and the protective front thigh underlayer of the present invention.
Figure 2:
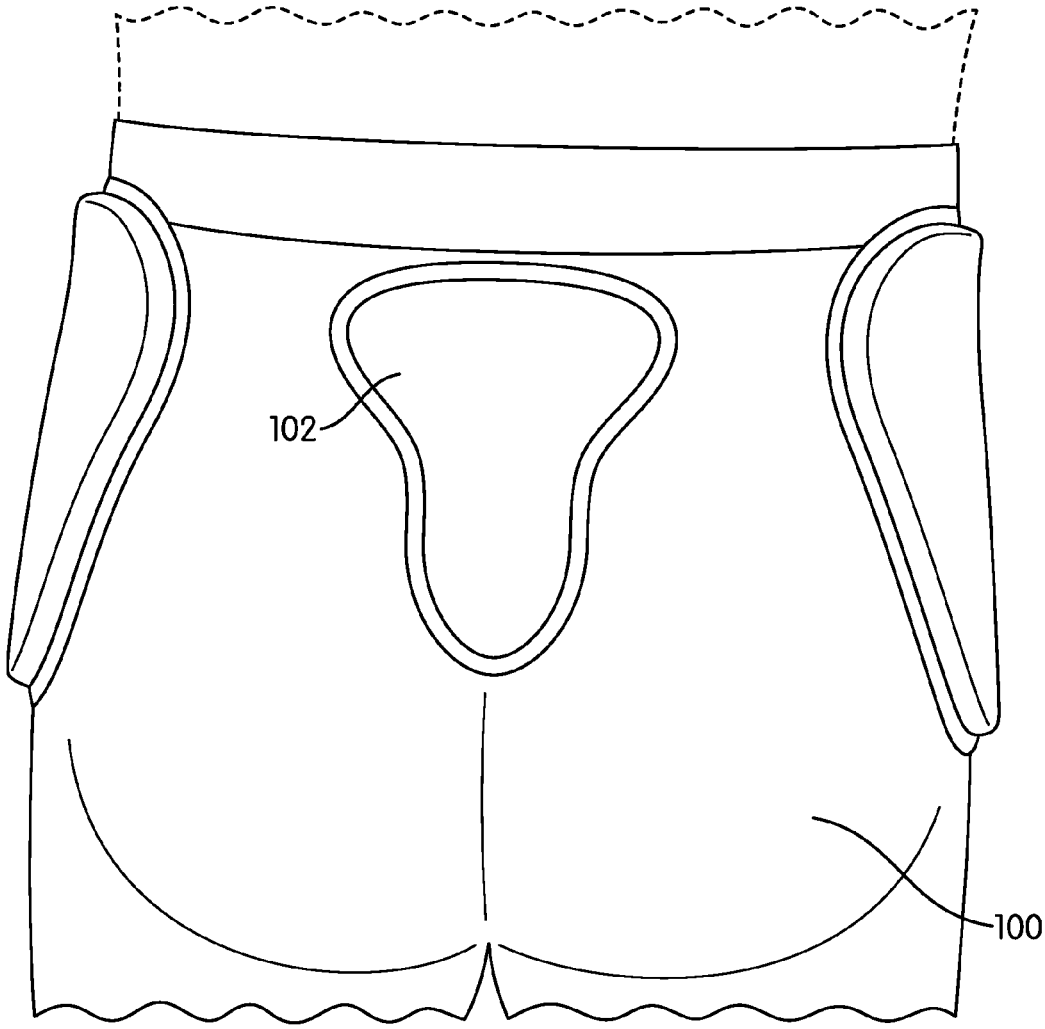
FIG. 2 is a rear view of the garment of FIG. 1 incorporating the protective coccyx underlayer.

An athletic garment containing protective underlayer elements is the lower body garment 100 shown in FIGS. 1 and 2. The lower body garment is made of a breathable material forming the outer fabric layer, and contains a protective hip underlayer element or pad 101, a protective coccyx underlayer element or pad 102, and a protective thigh underlayer or pad 103. FIG. 1 illustrates a side view of the lower body garment 100 showing the position of the protective hip underlayer 101 and protective thigh underlayer 103 with respect to the wearer. FIG. 2 is a rear view of the lower body garment 100 best illustrating the position of the protective coccyx underlayer 102 with respect to the wearer. Each underlayer element comprises a foam core preferably sandwiched between fabric coverings. The underlayer elements shown in FIGS. 1 and 2, for example, have an underlayer fabric covering over the foam core.

It is possible that the foam core is attached to only one fabric covering which is then attached to the fabric of the garment itself such that the foam core is sandwiched between its fabric covering and the fabric of the garment. The attachment of the underlayer element to the garment may be accomplished in any manner including but not limited to stitching, adhesion, or fusing of the underlayer fabric to the garment fabric, or the foam pad directly to the garment fabric. The underlayer largely takes its shape from the foam core. The foam core is perforated in particular configurations to provide flexibility and ventilation to the underlayer. Each of these elements is described in detail herein. Generally hip pad 101 has a unique shape as described below to facilitate articulation of the leg about the hip joint while providing protection to the iliac crest and femoral head. Coccyx pad 102 is anatomically shaped to protect the coccyx or tailbone area while providing needed ventilation to the region. And thigh pad 103 is anatomically shaped to protect the quadriceps area.

It will be understood that this invention is not limited to a lower body garment containing protective underlayers for the hip, coccyx and thigh, but that garment 100 is an example of the application of the principles of the invention. It is entirely within the scope of the invention to use appropriately configured underlayers in articulating and non-articulating shapes for any region of the body and incorporated into other types of athletic apparel or accessories.

Figure 3:
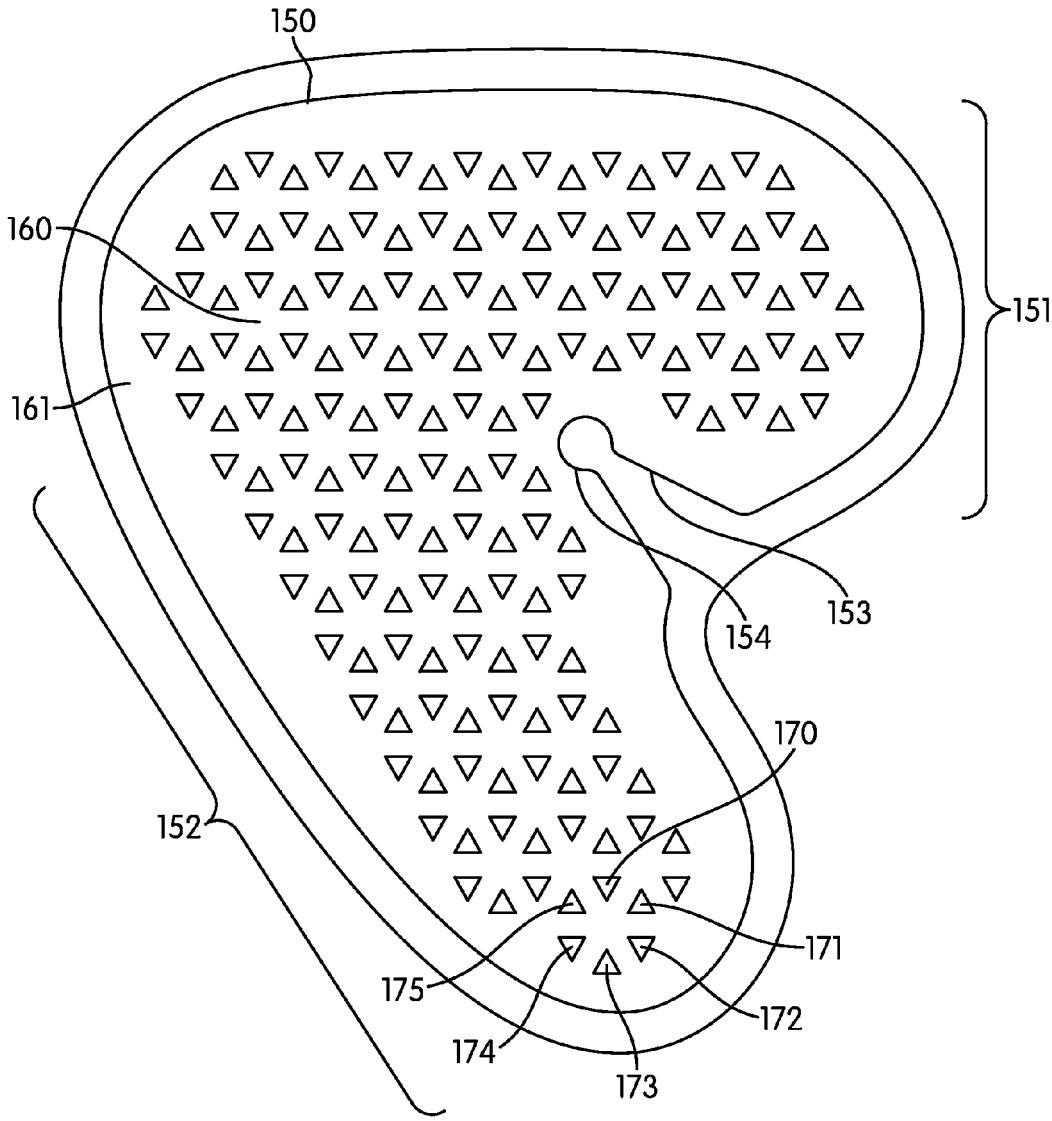
FIG. 3 is a schematic view of an articulating protective hip underlayer showing the internal perforation structure.
Figure 4:
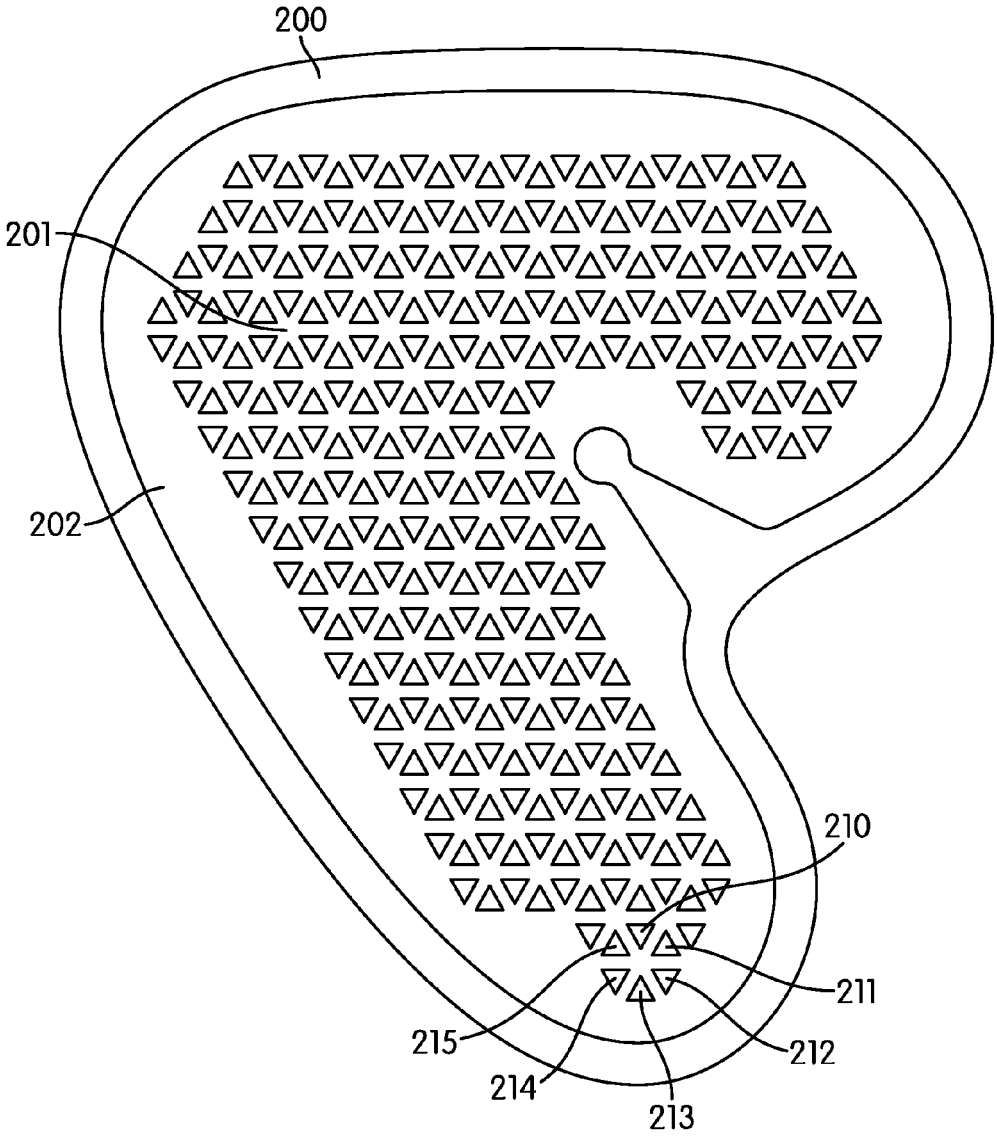
FIG. 4 is a schematic view of an articulating protective hip underlayer similar to FIG. 3, but showing an alternative internal perforation structure.
Figure 5:
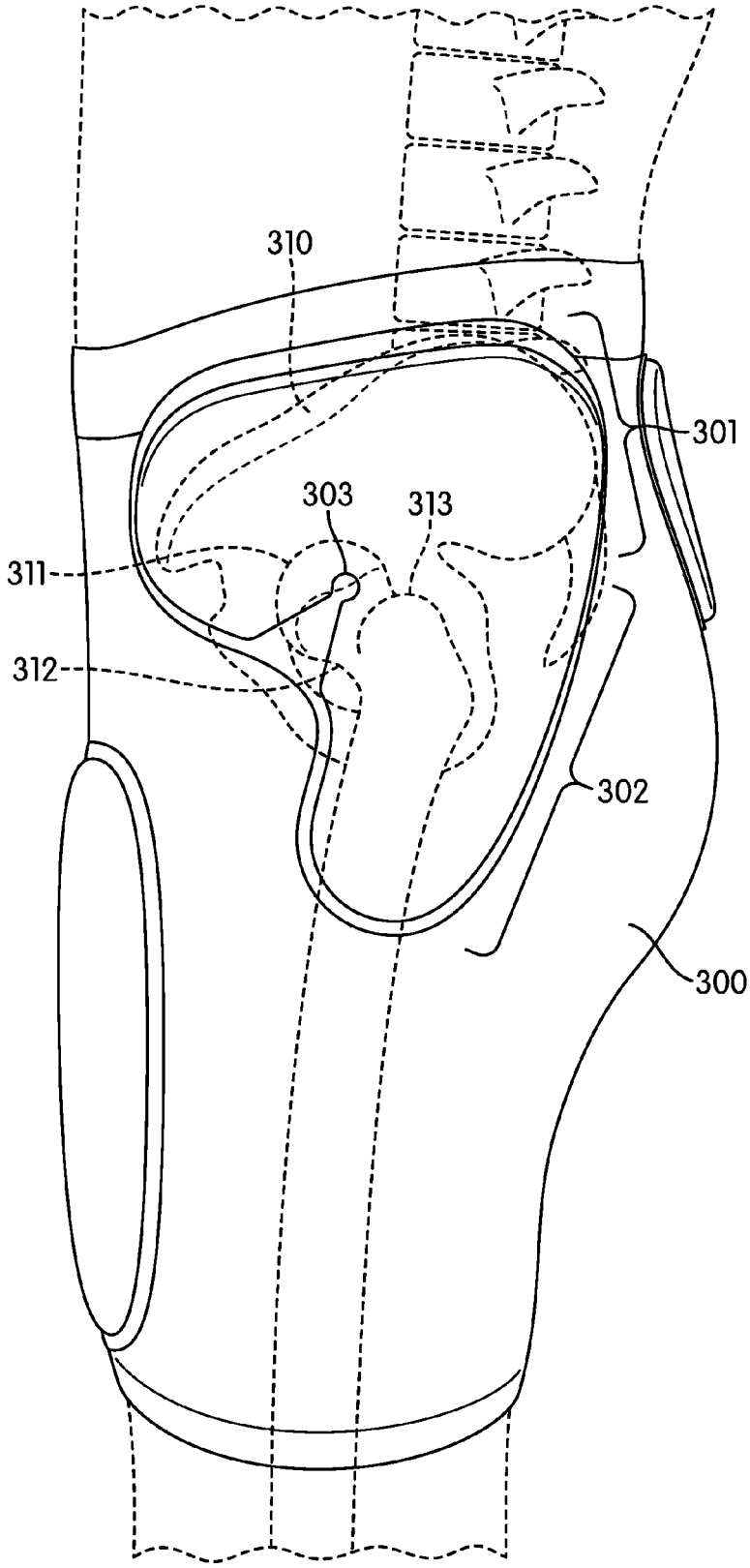
FIG. 5 is a side view of a lower body garment incorporating the articulated protective hip underlayer, demonstrating the location of the articulating notch with respect to the hip joint and the region of protection spanning distally from the femoral greater trochanter proximally to the iliac crest.

Hip underlayer 101 as shown in FIGS. 1 and 5 protects the left hip of the wearer, and the element shown in FIGS. 3-4 is for the right hip of the wearer. These are mirror images of each other and share identical features, and as such, only internal structure of the right element will be described in detail.

Referring to FIGS. 3-5, hip underlayer 101 is illustrated without its fabric covering so that the foam and its internal perforation structure is visible. The core of hip underlayer 101 is foam pad 150 which is sandwiched between fabric coverings, of which only bottom layer 140 is shown. Underlayer 101 takes its shape largely from the shape of foam pad 150, which as shown in FIG. 3 has an upper iliac protective region 151 and a lower femoral protective region 152. On the anterior aspect of the protective hip underlayer is a notch-cut feature 153 that allows for articulation about the axis of rotation of the hip. The shape of the iliac protective region 151 is curved about the longitudinal axis of the human body to match the curve of the iliac crest and provides protection beyond the anterior aspect and the posterior aspects of the iliac crest. The curvature of the protective hip underlayer provides a compact fit to the body, thus reducing the bulk generated by the underlayer. The shape of the femoral protective region 152 is such that it covers the lateral aspect of the femoral head and neck as well as the greater trochanter. These specific regions of the pelvis and femur are the most superficial and therefore most susceptible for injury due to impact. The protective hip layer is specifically shaped to cover these regions for use in high impact sports.

The notch-cut feature 153 of foam pad 150 contains a radiused articulating focal point 154 that is located some distance in from the outer edge of the protective underlayer and in between the upper iliac protective region 151 and the lower femoral protective region 152. Articulating focal point 154 may be located at any distance from the edge of the protective underlayer and be of varying radial dimensions, depending on the desired range of motion required for the wearer of the protective underlayer. The desired range of motion may vary depending on the sport or activity for which the garment is designed. The shape and contours of foam pad 150 provide an articulated underlayer to the garment that will not impede movement of the wearer and still provide protection.

Hip foam pad 150 is designed with a perforated region 160 and a continuous region 161. In this particular embodiment, foam element 150 can be thought of as having a single perforated region. Perforated region 160 provides added flexibility in the underlayer by enabling it to more easily curve to conform to the wearer's body, reduced weight, a feeling of lightness, as well as ventilation for enhanced comfort. Continuous region 161 provides a ring of enhanced support and protection to underlayer 150. In this embodiment continuous region 161 surrounds perforated region 160 and is thus located around the outer edge of the protective hip underlayer. It is possible to design the foam pad to have a plurality of perforated regions surrounded by a continuous region to provide rings of stiffer protection around the perforated regions. The perforated structure of the foam core can also be thought of as an aspect of articulation in that the perforations enhances the underlayer's ability to closely follow and lay against the curvature of the wearer's body.

With respect to the perforated region, the perforations are designed to provide a repeating lattice-like structure to the foam pad. In the embodiment shown in FIG. 3, the perforation pattern comprises an array of triangles arranged to form hexagonal clusters. In particular, perforations 170, 171, 172, 173, 174, 175 are equilateral triangles arranged such that an angle points toward a center point of a hexagon, and the opposing side implies a side of the hexagon. These perforations form six ribs that come together at the center point of the hexagon similar to an asterisk in shape. This star-like shape provides a great deal of structural strength to the foam pad and acts like a skeleton while providing flexibility and protection. The hexagonal cluster of triangles interlocks with adjacent hexagonal clusters, and this is achieved by arranging the equilateral triangles in parallel lines with each adjacent triangle rotated 60° with respect to its neighbor in the line. In FIG. 3, perforations 173, 174 and 175 are in the same line which is parallel to the line comprising perforations 170, 171 and 172. The size of the perforations may range from 1 mm to 20 mm and in the embodiment of FIG. 3, are preferably 6 mm on a side. In this embodiment, the spacing between triangles in a line is preferably 5 mm, and the foam pad is preferably 7 mm thick.

Although the illustrated perforations are equilateral triangular, they may be of any suitable geometry, including but not limited to right triangular, isosceles triangular, circular, square, rectangular, pentagonal, hexagonal, octagonal. Furthermore, the perforations 170, 171, 172, 173, 174, 175 may be spaced closer to each other or may be sized differently to provide particular, desired protective characteristics. The patterns may be, but are not limited to, circular, triangular, square, rectangular, pentagonal, hexagonal, octagonal, and are preferably hexagonal and spaced between 1 mm and 20 mm apart. The shape and spacing is selected depending on the desired degree of flexibility of the underlayer as well as the desired degree of protection of the underlayer. Additionally, the thickness of the foam pad will contribute to the degree of flexibility as well as the degree of protection. The larger the perforations, the closer the spacing, and the thinner the underlayer, the more flexibility and the less the degree of protection.

FIG. 4 illustrates another embodiment of the protective hip underlayer shown without a fabric covering to expose foam pad 200 with a perforated region 201 and a continuous region 202. This embodiment of the protective hip underlayer has a foam pad 200 that is 11 mm thick and has 6 mm equilateral triangular perforations 210, 211, 212, 213, 214, 215 arranged hexagonally and spaced at 3 mm. Similar to foam pad 150, the interlocking hexagonal pattern is repeated throughout the perforated region 201. The closer spacing of the perforations means that in the perforated region the sum of the void areas there is more overall results in a more flexible pad than the one illustrated in FIG. 3 in which there is more overall foam. The width of the continuous region surrounding the perforated region may also be altered to maximize the desired degree of protection and flexibility of the protective hip underlayer.

Proper function of the protective hip underlayer requires that the underlayer be positioned appropriately on the wearer so that the bulkiness is reduced, the coverage of the wearer's body is correct, and the axis of articulation of the protective underlayer is aligned with the axis of rotation of the hip joint during running. FIG. 5 illustrates proper positioning for the left hip so that the protective hip underlayer 300 is curved around the pelvis and the hip joint, is aligned such that the upper iliac protective region 301 provides complete coverage over the iliac crest 310 and the lower femoral protective region 302 provides complete coverage of the femoral head 311, femoral neck 312, as well as the greater trochanter 313. Furthermore, the notch-cut feature 303 of the pad in the protective hip underlayer is aligned with the axis of rotation of the hip. In this manner, the underlayer with its contoured pad anatomically fits the body part to be protected and also facilitates movement of the body.

A protective thigh underlayer in a lower body garment for protecting the front of the thigh is an additional embodiment of this invention. The protective thigh underlayer shape can vary depending on the degree of protection required and the particular areas of the thigh to be covered. Garment 100 provides padding on the quadriceps area of the thigh, FIG. 1, and this embodiment of the thigh underlayer is illustrated in more detail in FIG. 6. FIGS. 7-11 illustrate an alternative thigh pad which wraps around the lateral side of the thigh.

Figure 6:
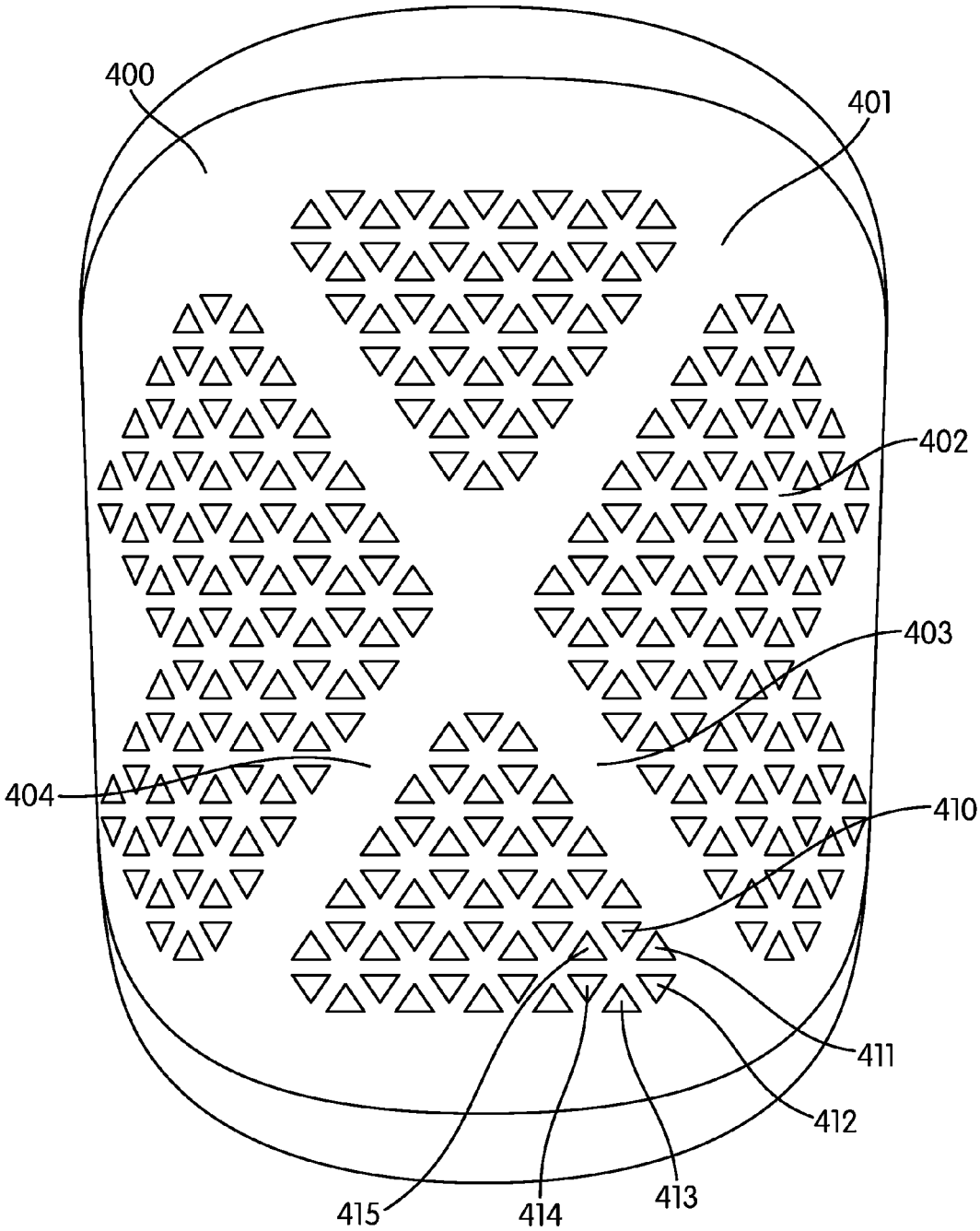
FIG. 6 is a schematic front view of a protective front thigh underlayer for protection from impacts on the anterior aspect of the thigh, showing X-shaped continuous region within the internal perforation structure.

Referring to FIG. 6, thigh underlayer 103 is shown without a fabric covering to reveal thigh pad 400 which is formed of a foam. Pad 400 is curved to match the natural curvature of the front of the thigh and comprises a continuous outer region 401 and a perforated region 402 reinforced by intersecting continuous regions 403, 404. Thigh pad 400 is sized so that it provides complete medial-lateral coverage of the thigh when observed from the front of the wearer and provides coverage over the middle third of the thigh in the coronal plane.

The intersecting continuous regions 403, 404 may intersect at all angles and are preferably aligned at an angle such that they generate an X-shaped pattern through the perforated region. The intersecting continuous regions provide protective reinforcement and needed stiffness for the large region of perforations. In embodiments such as the one illustrated in FIG. 6, the perforations can be described as a single perforated region reinforced with the continuous regions, or can be described as a plurality of perforated regions surrounded by continuous regions. Both of these descriptions are accurate and encompass the invention as illustrated in FIGS. 6 and 10, for example.

As in the hip underlayer, the perforated region provides the necessary flexibility to enable the pad to curve over the body part, in this case the thigh, and provide ventilation for enhanced comfort to the wearer. The perforation pattern is similar to that described with respect to the hip underlayer with equilateral triangular perforations 410, 411, 412, 413, 414 and 415 arranged in a grid pattern to form what appear to be interlocking hexagons. If focused on the foam instead of the voids, the perforations form asterisk shaped rib elements arranged in an array. Perforations 410, 411, 412, 413, 414, 415 may be of any geometry, including but not limited to circular, square, rectangular, equilateral triangular, right triangular, isosceles triangular, pentagonal, hexagonal, octagonal, and are preferably equilateral triangular in shape. The size of the perforations may range from 1 mm to 20 mm and are preferably 6 mm. The patterns may be, but are not limited to, circular, triangular, square, rectangular, pentagonal, hexagonal, octagonal, and are preferably hexagonal and spaced between 1 mm and 20 mm, and this embodiment of the protective thigh underlayer, foam pad 400 has a spacing of 3 mm. The protective thigh underlayer 400 illustrated in FIG. 6 represents a protective thigh underlayer that provides protective coverage for the front of the thigh, which will typically be used in high impact sports where the impact to the thigh most commonly occurs from the front of the wearer, such as football.

Figure 7:
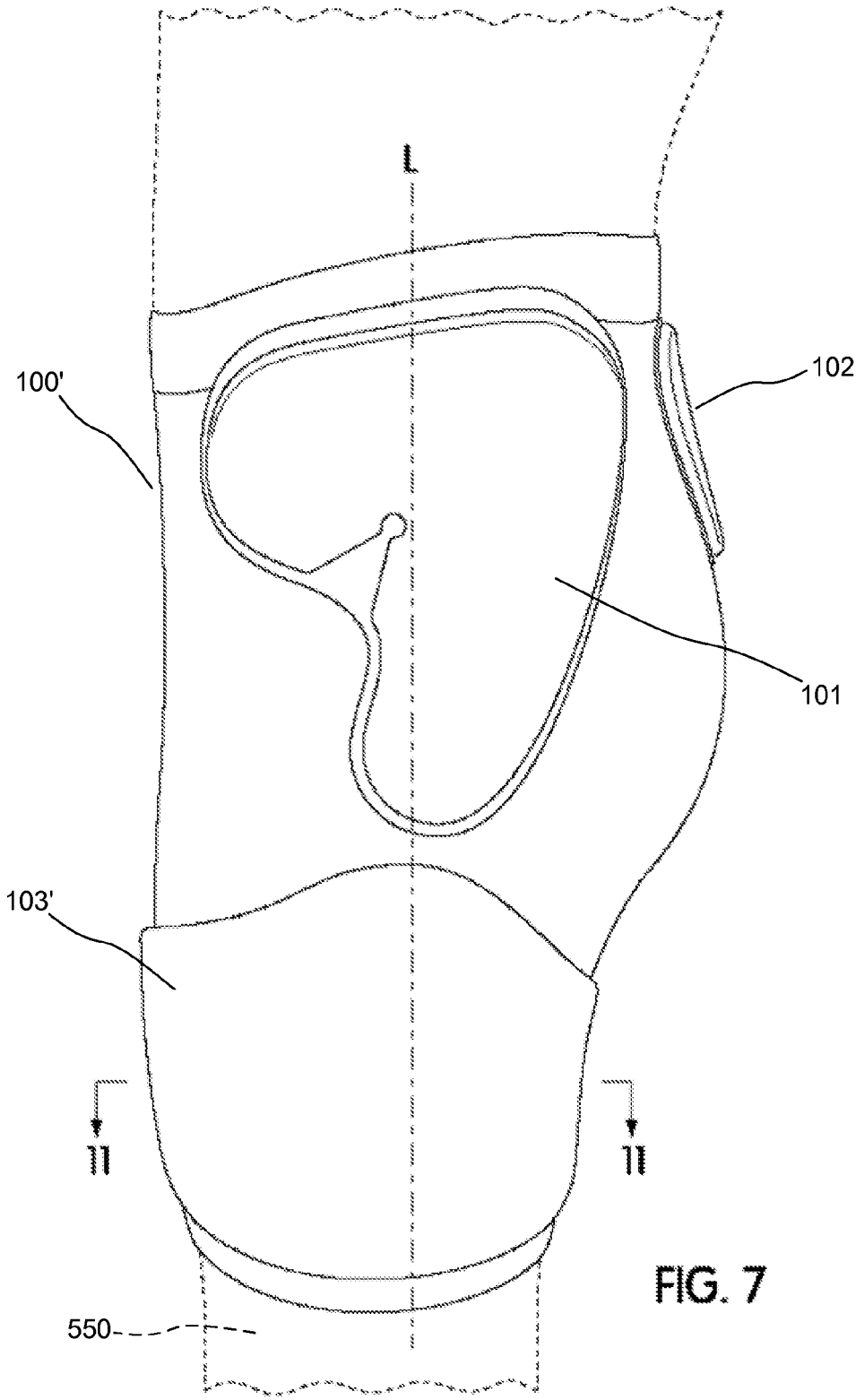
FIG. 7 is a side view of an athletic garment incorporating an alternative wrap thigh underlayer, an articulated protective hip underlayer and a protective coccyx underlayer.
Figure 8:
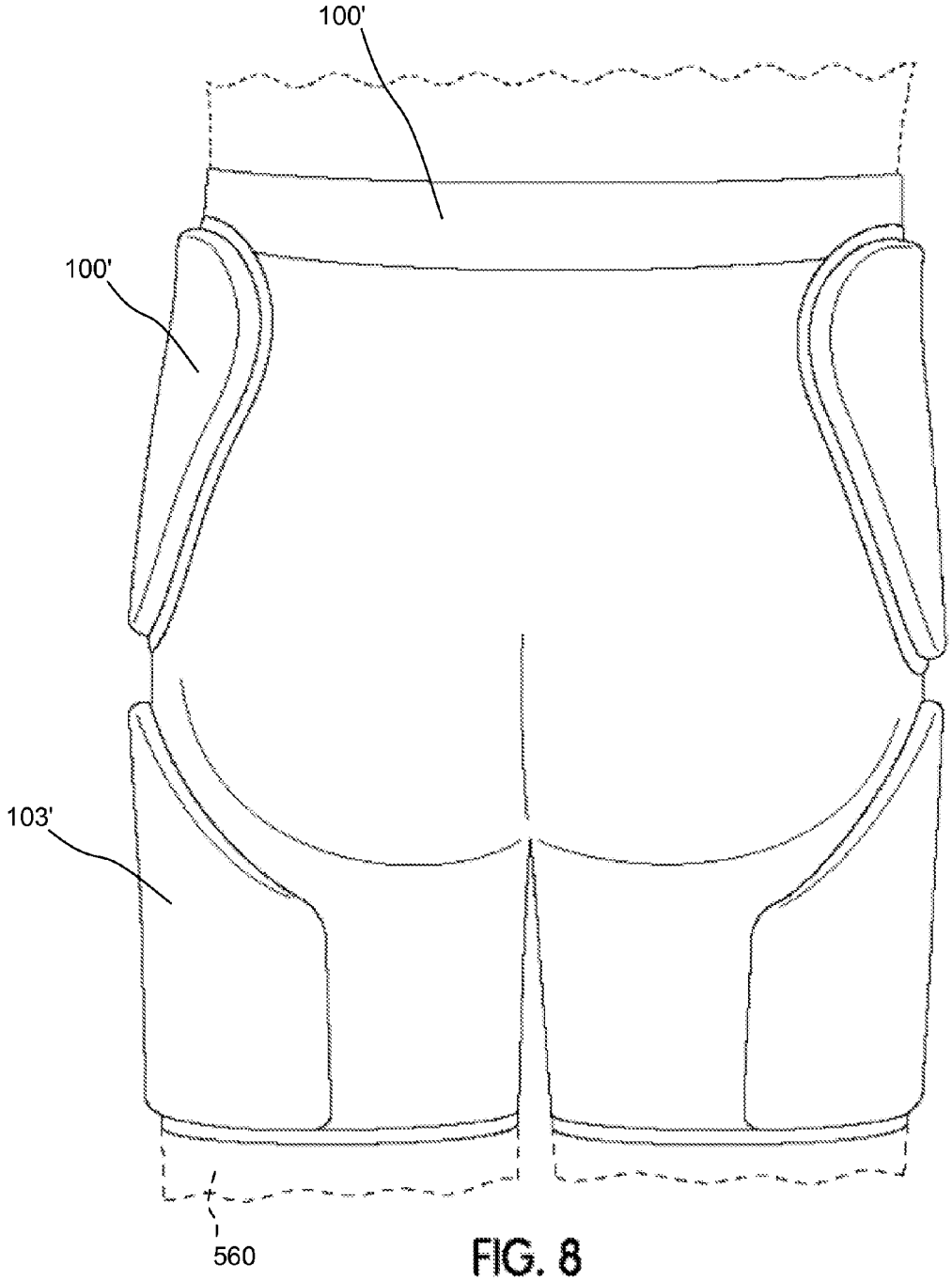
FIG. 8 is a rear view of the garment of FIG. 7.
Figure 9:
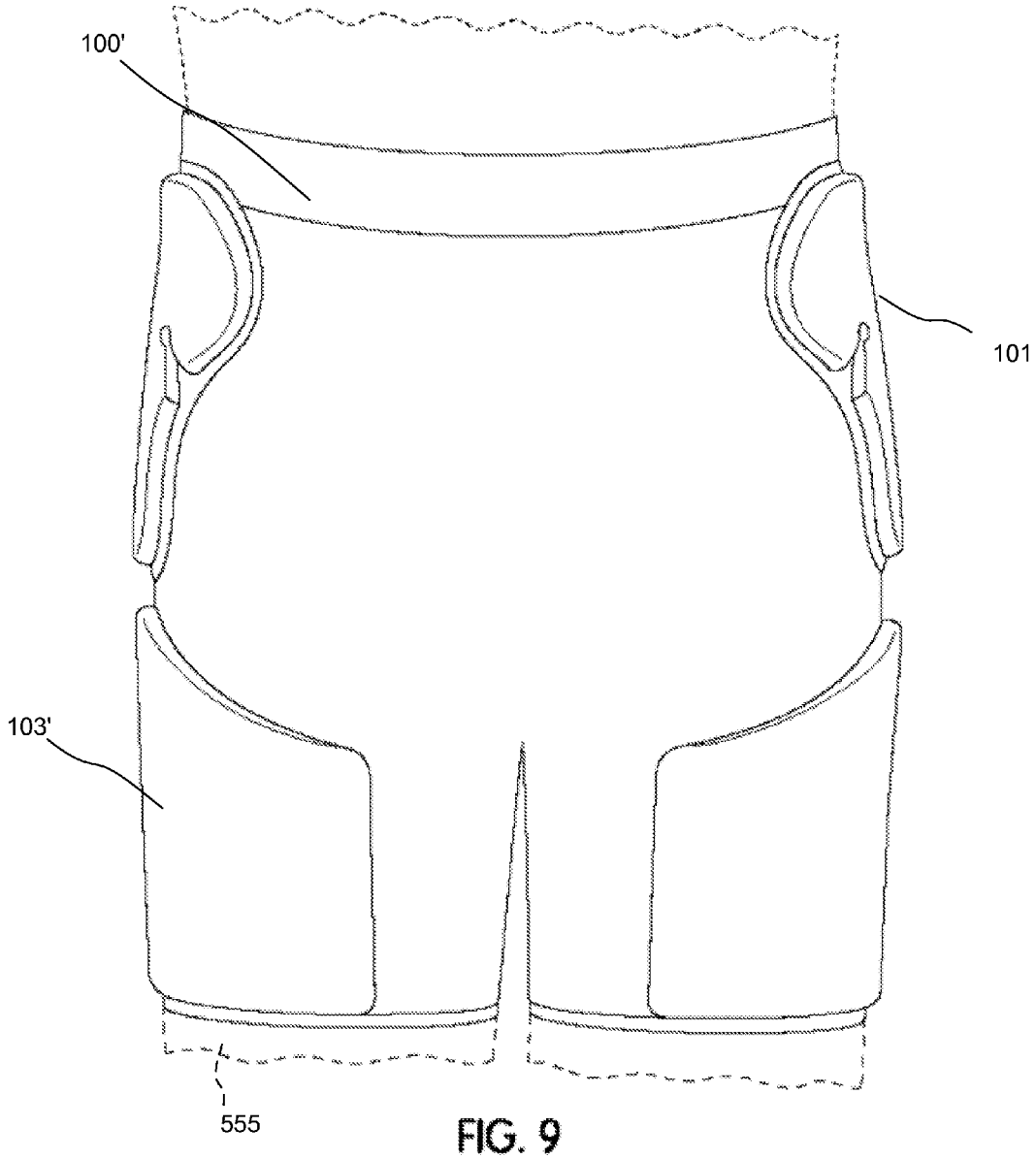
FIG. 9 is a front view of the garment of FIG. 7.
Figure 10:
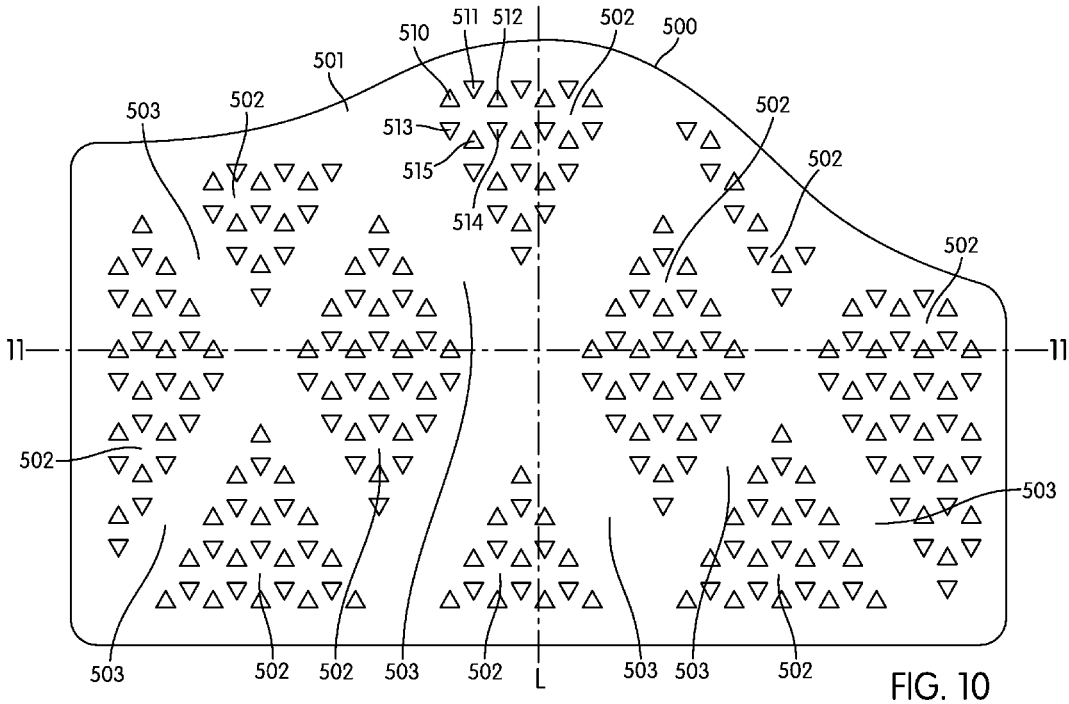
FIG. 10 is a schematic flattened view of the protective wrap thigh underlayer of FIG. 7 showing the curved shape to match the anatomy of the thigh.
Figure 11:
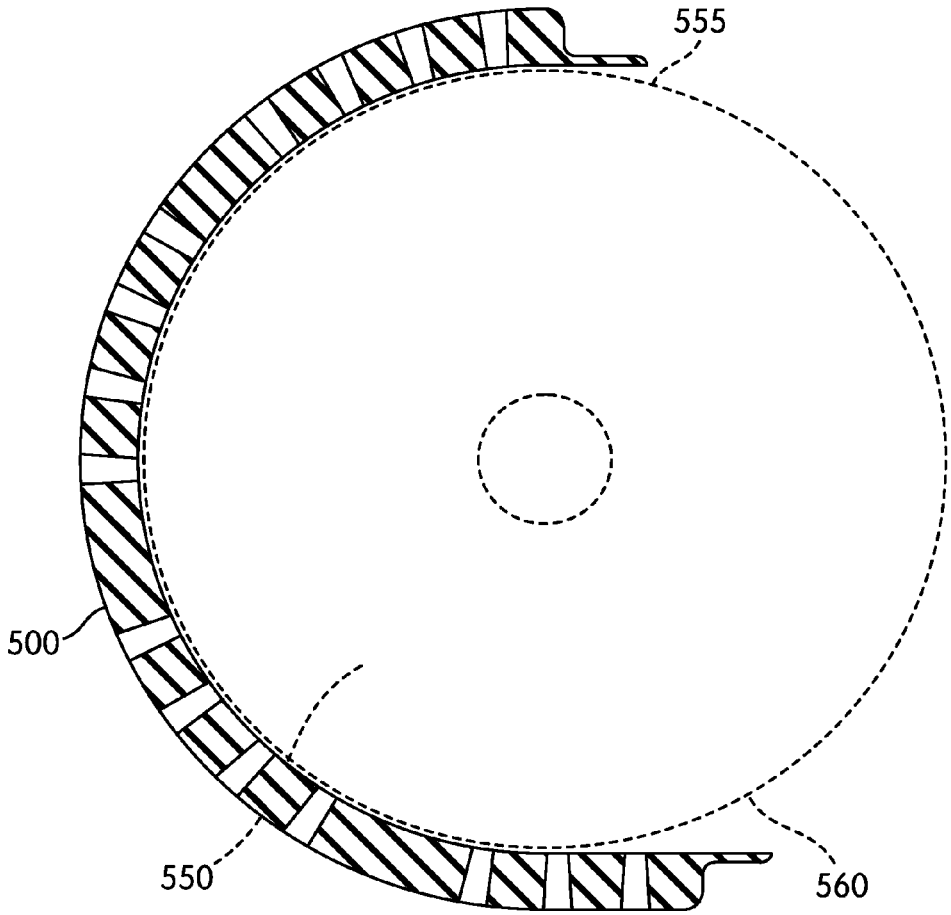
FIG. 11 is a schematic cross-section taken along line 11-11 of FIG. 7 of the protective wrap thigh underlayer for protection from impacts on all sides of the thigh, showing the X-shaped continuous regions within the internal perforation structure.

Referring to FIGS. 7-11, an alternative embodiment of the protective thigh underlayer as part of the lower body garment is described for impact to a more extensive portion of the thigh, such as may occur during play in basketball. Lower body garment 100' shown in FIGS. 7-9 and 11, includes hip underlayer 101, coccyx underlayer 102 and an alternative thigh underlayer 103'. As seen in FIGS. 7-9 and 11, thigh underlayer 103' extends around the lateral side of the thigh and covers the front of the thigh and the back of the thigh. Thus, it protects all of the exposed areas of the thigh from the quadriceps to the hamstrings. FIG. 10 illustrates thigh underlayer 103' without a fabric covering to expose foam pad 500 which is larger than thigh pad 400 illustrated in FIG. 6 to provide additional protection to the thigh. Line L in FIGS. 7 and 10 represents a longitudinal line along the lateral side of the thigh, in this case the left thigh, about which the curvature of underlayer 103' is focused. This is also seen in FIG. 11 which is a schematic cross-section of a protected thigh 550 showing the position of protective thigh pad 500 which is curved such that protective coverage begins on the anterior aspect 555 of thigh 550, and wraps around the outer thigh to end on the posterior aspect 560 of the thigh. The protective underlayer covers at a minimum the middle third of the thigh in the coronal plane.

Referring to FIG. 10, in the protective thigh pad 500 as illustrated, the left hand edge corresponds to the edge covering the anterior aspect 555, and the right hand edge corresponds to the edge covering the posterior aspect 560. It can be seen that thigh pad 500 is contoured specifically to wrap around the wearer's thigh and provide anatomical protection therealong. Specifically, the lateral side of the thigh has the most protection provided by the curved crest peaking at line L, and the posterior aspect has the lowest profile to ensure that the pad does not interfere with the movement of the legs and the resulting curvature of the posterior. Protective thigh pad 500 has a continuous region 501 around the edge as well as a central region consisting of a plurality of perforated regions 502 surrounded by intersecting continuous regions 503. The width of the continuous regions 503 can vary depending on the desired degree of protection and may be the same width throughout or may be of varying widths depending on the necessity for regions of concentrated enhanced protection. The perforated regions provide flexibility and ventilation for enhanced comfort to the wearer. The perforation pattern is the same as the other underlayers comprising perforations arranged in a grid pattern to form a repeating pattern of ribs and voids. Perforations 510, 511, 512, 513, 514, 515 may be of any geometry, including but not limited to circular, square, rectangular, equilateral triangular, right triangular, isosceles triangular, pentagonal, hexagonal, octagonal, and are preferably equilateral triangular in shape. The size of the perforations may range from 1 mm to 20 mm and are preferably 6 mm. The patterns may be, but are not limited to, circular, triangular, square, rectangular, pentagonal, hexagonal, octagonal, and are preferably hexagonal and spaced between 1 mm and 20 mm and this preferred embodiment of the protective thigh underlayer 500 has spacing of 5 mm.

Figure 12:
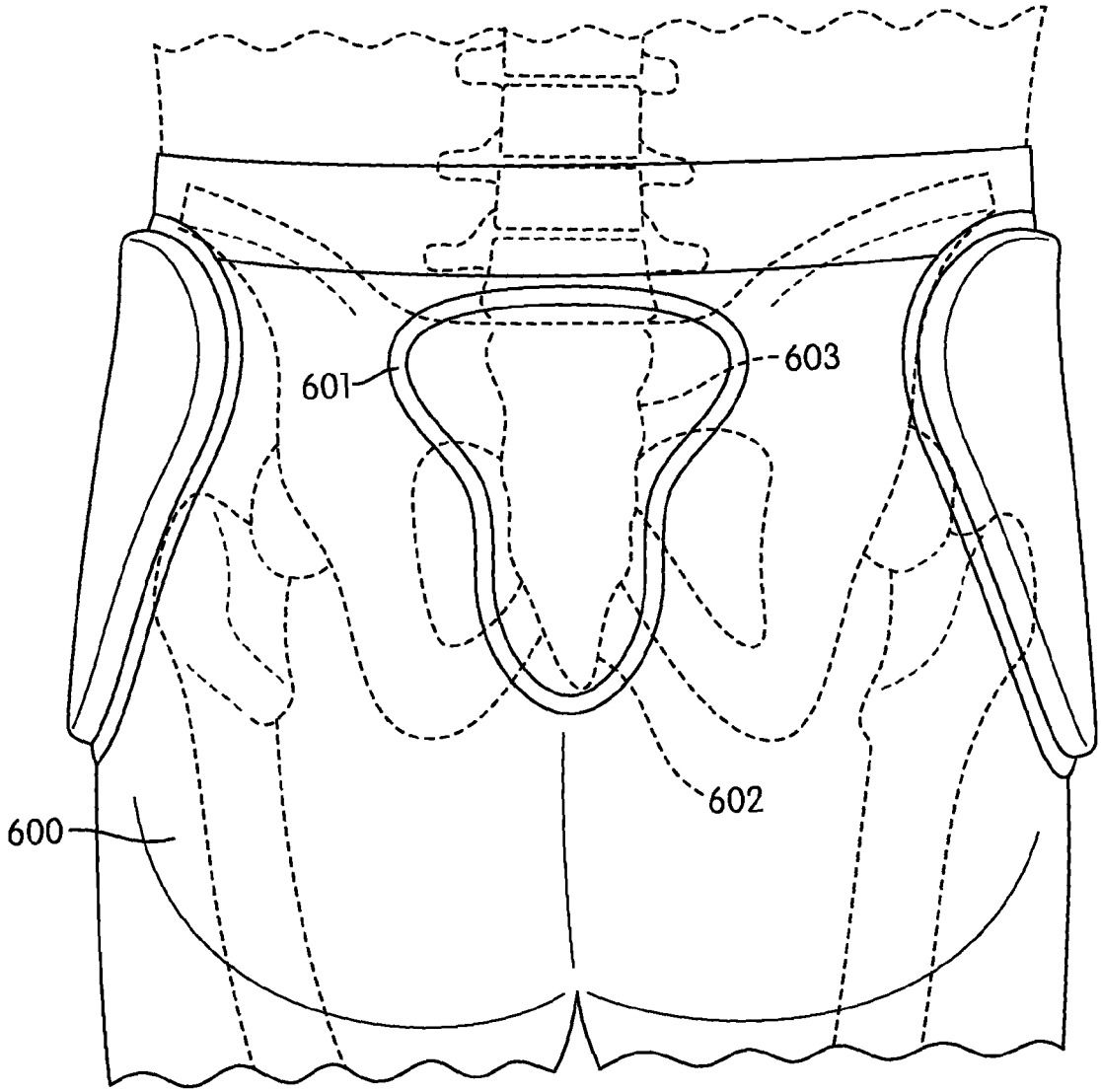
FIG. 12 is a schematic rear view of a lower body garment incorporating the protective coccyx underlayer, demonstrating the shape and location of the underlayer with respect to the coccyx.
Figure 13:
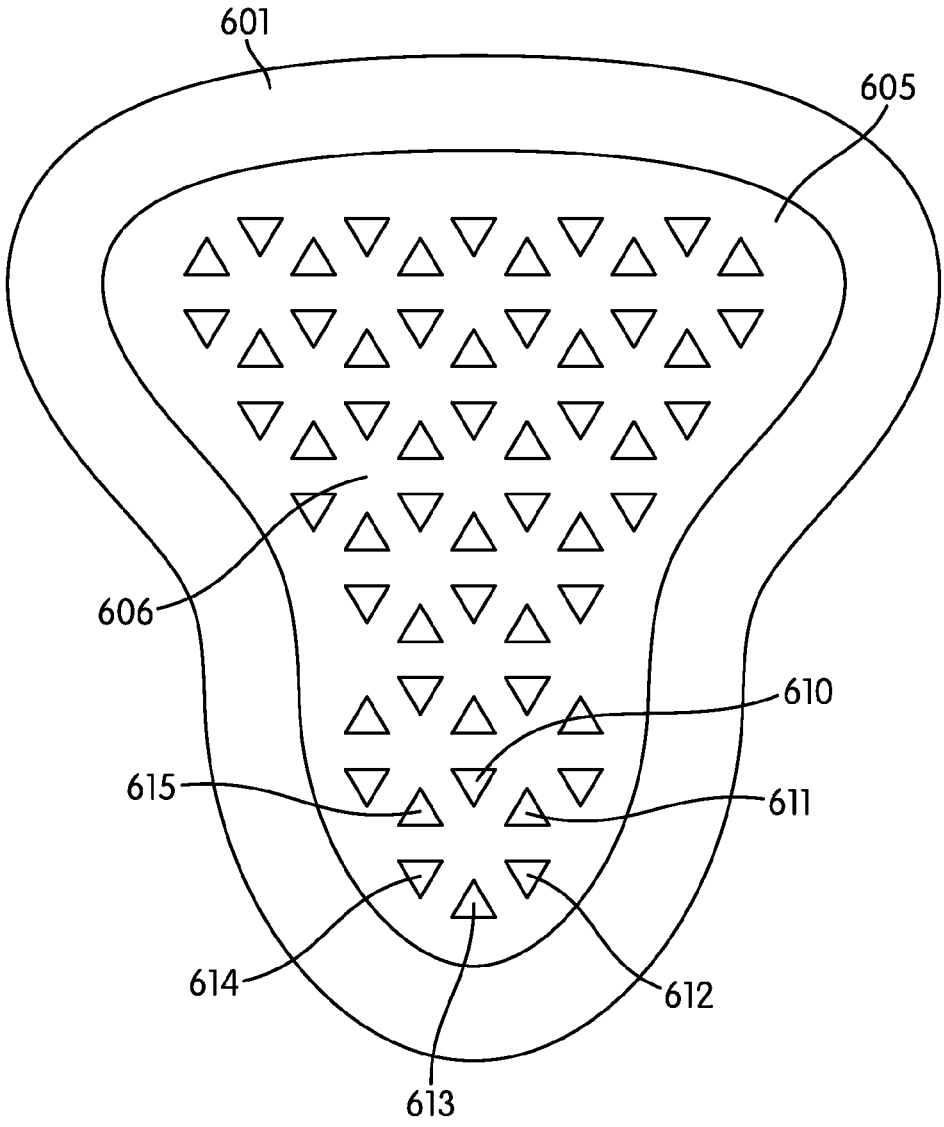
FIG. 13 is a schematic view of the protective coccyx underlayer showing the internal perforated structure.

The lower body garment may also contain a protective coccyx underlayer. Referring to FIGS. 12-13, a lower body garment 600 is illustrated having a protective coccyx underlayer 601 that is shaped and contoured such that it provides minimized bulk and covers the coccyx 602 and sacrum 603. The upper portion protecting the sacrum is wider than the lower portion protecting the coccyx, and as such the coccyx underlayer roughly has a T-shape. As depicted in FIG. 13, in which the fabric covering is not shown, protective coccyx underlayer 601 has a foam pad having a continuous region 605 around the outer edge of the protective pad surrounding a perforated region 606 in the center of the protective underlayer. The width of the continuous region 605 may vary depending on the desired degree of protection. The perforated region 606 provides flexibility and ventilation for enhanced comfort to the wearer. Again, the perforation pattern is similar to those described above with respect to the hip and thigh underlayers. Perforations 610, 611, 612, 613, 614, 615 may be of any geometry, including but not limited to circular, square, rectangular, equilateral triangular, right triangular, isosceles triangular, pentagonal, hexagonal, octagonal, and are preferably equilateral triangular in shape. The size of the perforations may range from 1 mm to 20 mm and are preferably 6 mm. The patterns may be, but are not limited to, circular, triangular, square, rectangular, pentagonal, hexagonal, octagonal, and are preferably hexagonal and spaced between 1 mm and 20 mm and this preferred embodiment of the protective coccyx underlayer 500 has spacing of 6.5 mm.

The padded underlayers due to the combination of their contoured shapes and particular perforation patterns provide anatomically correct protection to the body parts of the wearer. With respect to the foam pad, the main parameters of design are the thickness of the pad, the perforation pattern, the size of the perforations and the spacing of the perforations. These parameters can be utilized to customize the degree of protection, stiffness, flexibility, ventilation and articulation of the foam pad, and thereby the padded underlayer.

While various embodiments of the invention have been described, it will be apparent to those of ordinary skill in the art that may more embodiments and implementations are possible that are within the scope of the invention.

What is claimed is:

1. A protective lower body garment comprising:

a garment fabric for covering a portion of a wearer's body; and a hip padded underlayer attached to said fabric and positioned to be disposed over a wearer's hip joint, specifically a wearer's iliac crest, femoral head, femoral neck and greater trochanter, said underlayer incorporating a contoured molded foam pad with a triangular notch-cut to be disposed adjacent wearer's axis of rotation of the hip joint during running or walking, a point of said triangular notch-cut being located on the wearer's axis of rotation of the hip joint, wherein the notch-cut extends substantially from the wearer's axis of rotation of the hip joint to a perimeter edge of the padded underlayer.

2. The garment of claim 1, wherein said foam pad has a non-perforated continuous region surrounding a perforated region.

3. The garment of claim 2, wherein said perforated region comprises a repeating grid of perforations.

4. The garment of claim 3, wherein said repeating grid comprises interlocking hexagonal units, each said unit formed by triangular perforations arranged around a center point to form ribs therebetween.

5. The garment of claim 3, wherein said repeating grid comprises triangular perforations.

6. The garment of claim 5, wherein said perforations are in the shape of equilateral triangles.

7. A protective lower body garment comprising:

a garment fabric for covering a portion of a wearer's body;

a hip padded underlayer attached to said fabric and positioned to be disposed over a wearer's hip joint, specifically a wearer's iliac crest, femoral head, femoral neck and greater trochanter, said underlayer including a notch-cut to be disposed adjacent a wearer's axis of rotation of the hip joint during running or walking;

said notch-cut having a shape generally bounded by a first radius of a circle and a second radius of a circle, the circle having its center on the wearer's axis of rotation of the hip joint, wherein the notch-cut extends substantially from the wearer's axis of rotation of the hip joint to a perimeter edge of the padded underlayer;

a coccyx padded underlayer attached to said fabric and positioned to be disposed over a wearer's coccyx and sacrum;

wherein each said padded underlayer incorporates a contoured molded foam pad having a non-perforated area to provide enhanced protection and a perforated area to provide ventilation and reduce bulk.

8. The garment of claim 7, wherein each of said hip and coccyx foam pads each have a non-perforated continuous region surrounding a perforated region.

9. The garment of claim 8, wherein said perforated region comprises a repeating grid of perforations.

10. The garment of claim 9, wherein said repeating grid comprises interlocking hexagonal units, each said unit formed by triangular perforations arranged around a center point to form ribs therebetween.

11. The garment of claim 7, further comprising a thigh underlayer attached to said fabric and positioned to be disposed over a portion of a wearer's thigh, said thigh underlayer also incorporating a contoured molded thigh foam pad having a continuous non-perforated area to provide enhanced protection and a perforated region.

12. The garment of claim 11, wherein the thigh underlayer and said thigh foam pad are shaped and contoured to provide coverage from the medial anterior aspect to the lateral anterior aspect of the thigh.

13. The garment of claim 12, wherein said thigh foam pad has a plurality of perforated regions each surrounded by continuous areas, each said perforated region comprising a repeating grid of perforations.

14. The garment of claim 11, wherein the thigh underlayer and said thigh foam pad are shaped and contoured to form front, side and rear portions to provide coverage from the medial anterior aspect of the thigh around the lateral aspect of the thigh to the medial posterior aspect of the thigh.

15. The garment of claim 14, wherein said thigh foam pad has a plurality of perforated regions each surrounded by continuous areas, each said perforated region comprising a repeating grid of perforations.

16. A protective lower body garment comprising:

a garment fabric for covering a portion of a wearer's body;

a hip padded underlayer attached to said fabric and positioned to be disposed over a wearer's hip joint, specifically a wearer's iliac crest, femoral head, femoral neck and greater trochanter, said underlayer including a notch-cut to be disposed adjacent a wearer's axis of rotation of the hip joint during running or walking;

said notch-cut having a generally triangular shape, where one point of the notch-cut is located at the wearer's axis of rotation of the hip, wherein the notch-cut extends substantially from the wearer's axis of rotation of the hip joint to a perimeter edge of the padded underlayer;

a thigh underlayer attached to said fabric and positioned to be disposed over a portion of a wearer's thigh;

wherein each said padded underlayer incorporates a contoured molded foam pad having a non-perforated area to provide enhanced protection and a perforated area to provide ventilation and reduce bulk.

17. The garment of claim 16, wherein the thigh underlayer and said thigh foam pad are shaped and contoured to provide coverage from the medial anterior aspect to the lateral anterior aspect of the thigh.

18. The garment of claim 17, wherein each of said foam pads has a plurality of perforated regions each surrounded by continuous areas, each said perforated region comprising a repeating grid of perforations.

19. The garment of claim 18, wherein said repeating grid comprises interlocking hexagonal units, each said unit formed by triangular perforations arranged around a center point to form ribs therebetween.

20. The garment of claim 16, wherein the thigh underlayer and said thigh foam pad are shaped and contoured to form front, side and rear portions to provide coverage from the medial anterior aspect of the thigh around the lateral aspect of the thigh to the medial posterior aspect of the thigh.

21. The garment of claim 19, wherein said of said foam pads has a plurality of perforated regions each surrounded by continuous areas, each said perforated region comprising a repeating grid of perforations.

22. The garment of claim 20, wherein said repeating grid comprises interlocking hexagonal units, each said unit formed by triangular perforations arranged around a center point to form ribs therebetween.

23. The garment of claim 1, wherein said triangular notch-cut is located towards the front of the wearer's body, so as to positively bias the flexure of the molded foam pad consistent with running or walking movement.

24. The garment of claim 7, wherein the first radius and the second radius are disposed in such a manner that an area between them changes as a result of flexing of the hip padded underlayer due to rotation of the wearer's hip joint during running or walking.

25. The garment of claim 16, wherein the notch-cut changes from a first configuration having a first triangular shape to a second configuration having a second triangular shape, the first triangular shape being different from the second triangular shape, due to rotation of the wearer's hip joint during running or walking.

* * * * *